United States Patent [19]

DeFreitas

[11] 4,303,800

[45] Dec. 1, 1981

[54] REPRODUCING MULTICHANNEL SOUND

[75] Inventor: Richard E. DeFreitas, Westford, Mass.

[73] Assignee: Analog and Digital Systems, Inc., Wilmington, Mass.

[21] Appl. No.: 41,984

[22] Filed: May 24, 1979

[51] Int. Cl.[3] ..... H04R 5/04

[52] U.S. Cl. ..... 179/1 G

[58] Field of Search ..... 179/1 G, 1 GQ, 1 J

[56] References Cited

U.S. PATENT DOCUMENTS

| | | | |
|---|---|---|---|
| 3,067,292 | 12/1962 | Minter | 179/1 G X |
| 3,725,586 | 4/1973 | Iida | 179/1 G |
| 3,919,480 | 11/1975 | Fukami | 179/1 GQ |
| 3,982,069 | 9/1976 | Takahashi | 179/1 GQ |
| 4,027,101 | 5/1977 | DeFreitas et al. | 179/1 GQ |
| 4,049,912 | 9/1977 | Mitchell | 179/1 GQ |
| 4,087,629 | 5/1978 | Atoji et al. | 179/1 G |
| 4,097,689 | 6/1978 | Yamada et al. | 179/1 G |
| 4,151,369 | 4/1979 | Gerzon | 179/1 GQ |

FOREIGN PATENT DOCUMENTS

| | | | |
|---|---|---|---|
| 1196711 | 7/1965 | Fed. Rep. of Germany | 179/1 G |

OTHER PUBLICATIONS

"Coded Stereo for Hi-Fi," N. H. Crowhurst, *Radio & TV News,* Jun. 1957, pp. 60, 61 & 107.

"Time Delay for Ambience," Leonard Feldman, *Audio,* Dec. 1976, pp. 40-50.

*Primary Examiner*—Thomas W. Brown

[57] ABSTRACT

Apparatus for extracting recorded natural ambience from two audio channels while eliminating the cave-like quality of the sound of a soloist or announcer. The two channels are combined such that signals common to the two channels in a midrange of audio frequencies are cancelled, and the combined signal is time delayed.

9 Claims, 3 Drawing Figures

REPRODUCING MULTICHANNEL SOUND

FIELD OF THE INVENTION

This invention relates to reproducing multichannel sound.

BACKGROUND OF THE INVENTION

To enhance the accuracy of sound reproduction, it is desirable to reproduce reflected sound or echoes. This component, often referred to as ambiance, is generated by sound reflection off the walls and other surfaces of a concert hall, and thus its source is generally behind or to the side of the listener. Quadrophonic sound recordings can reproduce ambiance by recording on their rear channels sound that emanates from the rear. Stereophonic recordings, on the other hand, lack these rear recorded channels. Various systems have been employed to create ambiance from the two stereo channels. One technique is to play a delayed version of the stereo channels from rear speakers. This works reasonably well for orchestral music in which variously located instruments play simultaneously. But the systems give an unnatural quality to the sound of a solo instrument or vocalist, including a radio announcer, making the sound appear to emanate from a cave.

Another approach to simulating live sound from two stereo channels is the so-called "surround sound" approach in which, e.g., pure left-channel sound appears to come from the left rear or side of the listener while monaural sound (i.e., sound common to both left and right channels) appears to come from between the front two speakers. Iida U.S. Pat. No. 3,725,586 discloses such a system. Each left and right channel is applied to a phase-shifting circuit and a low-pass filter. Forward speakers are driven by the outputs of the phase-shifting circuits. Rear speakers are driven by the sum of a filtered signal and a phase-shifted signal from opposite channels (e.g., left filtered plus right phase-shifted giving right rear). The relative phase shift between the summed signals is 180° at about 650 to 700 Hz and approaches 270° at higher frequencies. The monaural signal on the two channels is thereby attenuated in the rear speakers, most greatly at 650 to 700 Hz and to a lesser degree at higher frequencies. The filters are used to preserve left and right side localization of sound.

SUMMARY OF THE INVENTION

I have found a simple combination of processing elements that greatly improves the ambiance of reproduced music. The invention eliminates the irritating, cave-like quality of soloists and announcers so common in conventional ambiance-simulating systems, while extracting the recorded natural ambiance present in two audio channels. The invention is most suited for creating rear channels from two conventional stereo channels, but it could as well be used in systems with more than two channels by treating two channels at a time to extract further ambiance.

The invention features combining two channels, by phase shifting one channel and summing the phase-shifted signal with the other channel, so as to greatly attenuate signals common to the channels in a midrange of audio frequencies, and delaying the combined, ambiance signal to provide an output signal (e.g., for driving a rear speaker).

In some preferred embodiments, the midrange of frequencies is 300 Hz to 3000 Hz, the phase shift is nearest to 180 degrees in the middle of the range, neither channel's signal is attenuated prior to summing, and the two channels are combined in a similar but reversed manner to produce a second ambiance signal. In other preferred embodiments, two output signals of different delay are produced from one ambiance signal.

PREFERRED EMBODIMENTS

The circuitry and operation of preferred embodiments of the invention will now be described, after first briefly describing the drawings.

Figure 1:
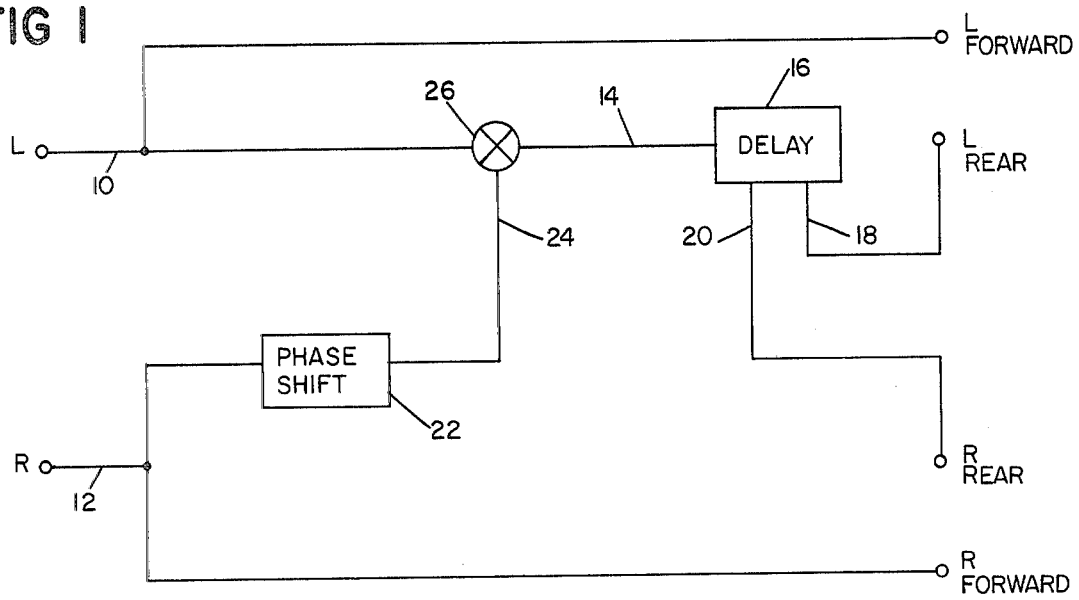
FIG. 1 is a block diagram of a preferred embodiment.

Referring to FIG. 1, left and right incoming audio channels 10, 12 are combined to produce a single ambiance channel 14, which is then time delayed at block 16 to produce two differently-delayed, rear channels 18, 20. Before combining the incoming channels, the right one is processed through phase-shifter 22, which does not attenuate but shifts the phase of a midrange of frequencies (300 Hz to 3000 Hz) by varying amounts up to about 180°. Phase-shifted output 24 is then summed with left channel 10 at summer 26.

Figure 2:
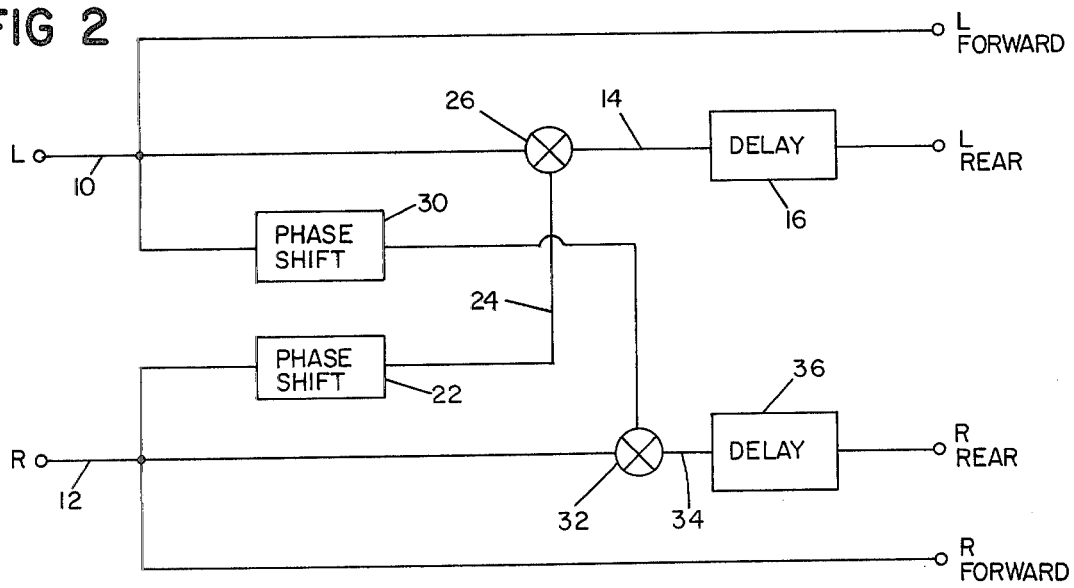
FIG. 2 is a block diagram of an alternative embodiment.

Shown in FIG. 2 is an alternative embodiment of the invention having a second phase-shifter 30 and summer 32. The second phase-shifter 30 treats the left channel signal, and the phase-shifted left signal is summed with the right signal at summer 32 to produce a second ambiance signal 34, which is then passed through a second delay unit 36. The output of delay unit 36 can drive a right rear speaker, and the output of delay unit 16 a left rear speaker.

Figure 3:
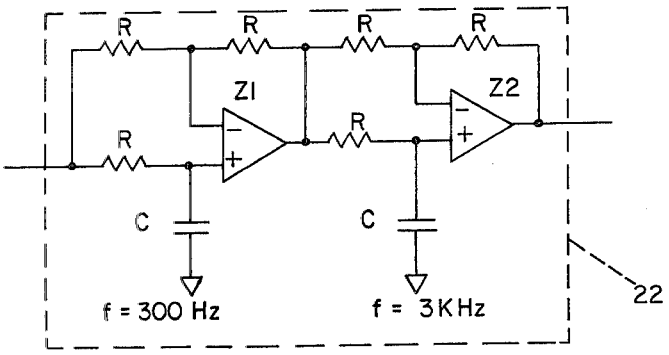
FIG. 3 is a schematic of the phase-shifting circuit.

The phase-shifter circuitry of the blocks 22, 30 is shown in FIG. 3. Identical resistors R and identical capacitors C work in conjunction with operational amplifiers Z1, Z2 (e.g., a Motorola 1458 type). The frequency response of the phase-shift circuit has nearly zero phase shift at 300 Hz and nearly 360 degrees (equivalent to zero) phase shift at 3000 Hz. At the logarithmic center of the range, about 800 Hz, the phase shift is 180 degrees. In between these points the phase varies gradually.

In operation, phase shifter 22 and summer 26 cause signals common to left and right channels 10, 12 to be greatly attenuated in the ambiance channel 14, and thus sound from a soloist or announcer is not heard from the rear, delayed channels. This eliminates the cave-like quality of such sound. The cancellation is achieved because the midrange frequencies of the right channel are shifted in phase nearly 180 degrees, and thus cancel with identical signals in the left signal at summer 26. Greatest cancellation occurs at the middle of the range (800 Hz), with gradually less cancellation towards the low and high end of the 300 to 3000 Hz interval. Cancellation is not desirable at the high frequencies (above about 3000 Hz) because it tends to increase the noise level in the ambiance signal. At the low frequency end, cancellation is also less desirable, as the amount of natural ambiance extracted does not compensate for the loss of low frequency sound in the ambiance signal.

Left and right localization of sound is not lost by combining left and right channels because the combined signal is delayed and thus does not influence localization.

The cancellation also has the effect of extracting recorded natural ambience because reflected sound, whether naturally occurring in a concert hall recording or added electroncially to a studio recording, is not common to both channels and thus is not cancelled by the phase shift and summation stages. In this way a greater portion of the delayed rear channels is natural ambiance, and thus produces a more natural sound than when the entire content of the forward channels is delayed.

Other embodiments of the invention are within the following claims. For example, delay networks 16, 36 could provide pure delays for the two rear channels 18, 20, or the networks could include any of the conventional audio delay circuits that cross couple delayed outputs to further enhance ambiance. An example of the latter is disclosed in Mitchell U.S. Pat. No. 4,049,912. For the embodiment of FIG. 2, cross coupling the delay networks would require interconnections between delay units 16 and 36. In the embodiment of FIG. 1, the two rear channels could be replaced by a single, monaural-channel driving one or more speakers.

What is claimed is:

1. Apparatus for reproducing sound from a plurality of audio input channels, comprising:

means for combining a first and second of said channels carrying a first signal and a second signal respectively such that signals common to the channels in a middle audio frequency range are attenuated, said means comprising means for phase shifting said first signal and means for summing said phase-shifted first signal with said second signal to produce an ambiance signal, and means for delaying said ambiance signal and providing said signal as an output.

2. The apparatus of claim 1 wherein said frequency range extends from 300 Hz to 3000 Hz and said phase shift is nearest to 180 degrees in the middle of said range.

3. The apparatus of claim 1 further comprising second means for combining said first and second signals, said means comprising means for phase shifting said second signal and means for summing said phase-shifted second signal with said first signal to produce a second ambiance signal and means for delaying said second ambiance signal and providing said signal as a second output.

4. The apparatus of claim 1 wherein said means for delaying said ambiance signal includes means for producing two output signals with different delays.

5. A method for reproducing sound from a plurality of audio input channels, comprising the steps of:

combining a first and second of said channels carrying first signal and a second signal respectively such that signals common to the channels in a middle audio frequency range are cancelled, by phase shifting said first signal and summing said phase-shifted first signal and said second signal to produce an ambiance signal, and delaying said ambiance signal.

6. The method of claim 5 further comprising the steps of:

combining said first and second signals, by phase shifting said second signal and summing said phase-shifted second signal with said first signal to produce a second ambiance signal, and delaying said second ambiance signal.

7. The method of claim 5 further comprising the step of playing said ambiance signal behind a listener.

8. Apparatus for reproducing sound from a plurality of audio input channels, comprising:

means for combining a first and second of said channels carrying a first signal and a second signal respectively such that signals common to the channels in a middle audio frequency range are attenuated, said means comprising means for phase shifting said first signal and means for summing said phase-shifted first signal with said second signal to produce an ambiance signal, the audio frequency components of said first and second signals only being attenuated at or after summing by said means for summing, and means for delaying said ambiance signal and providing said signal as an output.

9. Apparatus for reproducing sound from a plurality of audio input channels, comprising:

means for combining a first and second of said channels carrying a first signal and a second signal respectively such that signals common to the channels in a middle audio frequency range are attenuated, said means comprising means for phase-shifting said first signal wherein said means for phase-shifting only produces a relative phase shift between said first and second signals at frequencies at or below 3000 Hz so as to prevent attenuation of said common signals at frequencies above 3000 Hz and an increase in noise level in an ambiance signal, means for summing said phase-shifted first signal with said second signal to produce said ambiance signal, and means for delaying said ambiance signal and providing said signal as an output.

* * * * *